US005855695A

United States Patent [19]

McMillen et al.

[11] Patent Number: 5,855,695

[45] Date of Patent: *Jan. 5, 1999

[54] NON-CHROME POST-RINSE COMPOSITION FOR PHOSPHATED METAL SUBSTRATES

[75] Inventors: Mark W. McMillen, Oxford, Mich.; Richard M. Nugent, Jr., Allison Park, Pa.

[73] Assignee: PPG Industries, Inc., Pittsburgh, Pa.

[ * ] Notice: The term of this patent shall not extend beyond the expiration date of Pat. No. 5,653,823.

[21] Appl. No.: 786,561

[22] Filed: Jan. 21, 1997

Related U.S. Application Data

[62] Division of Ser. No. 546,024, Oct. 20, 1995, Pat. No. 5,653,823.

[51] Int. Cl.[6] ..... C23C 22/48

[52] U.S. Cl. ..... 148/247; 106/14.44; 148/257; 427/388.1

[58] Field of Search ..... 148/247, 257; 106/14.44; 427/388.1

[56] References Cited

U.S. PATENT DOCUMENTS

| | | | |
|---|---|---|---|
| 3,615,895 | 10/1971 | Freyhold et al. | 148/6.15 R |
| 3,749,611 | 7/1973 | Leon et al. | 148/257 |
| 3,912,548 | 10/1975 | Faigen | 148/6.15 R |
| 3,961,993 | 6/1976 | Palisin, Jr. | 148/257 |
| 3,966,502 | 6/1976 | Binns | 148/6.14 R |
| 3,975,214 | 8/1976 | Kulick et al. | 148/6.15 R |
| 4,110,129 | 8/1978 | Matsushima et al. | 148/6.15 R |
| 4,132,572 | 1/1979 | Parant et al. | 148/6.15 R |
| 4,186,036 | 1/1980 | Elms et al. | 148/257 |
| 4,331,715 | 5/1982 | Wolpert | 148/257 |
| 4,376,000 | 3/1983 | Lindert | 148/6.15 R |
| 4,433,015 | 2/1984 | Lindert | 427/388.4 |
| 4,457,790 | 7/1984 | Lindert et al. | 148/6.15 R |
| 4,517,028 | 5/1985 | Lindert | 148/6.14 R |
| 4,714,752 | 12/1987 | Sokalski | 528/153 |
| 4,775,600 | 10/1988 | Adaniya et al. | 428/623 |
| 5,080,733 | 1/1992 | Deresh | 148/266 |
| 5,209,788 | 5/1993 | McMillen et al. | 148/247 |
| 5,385,655 | 1/1995 | Brent et al. | 148/257 |
| 5,449,415 | 9/1995 | Dolan | 148/251 |
| 5,653,823 | 8/1997 | McMillen et al. | 148/247 |

FOREIGN PATENT DOCUMENTS

| | | |
|---|---|---|
| 2255393 | 7/1975 | France . |
| 2604729 | 8/1988 | France . |
| 1486820 | 9/1977 | United Kingdom . |
| WO95/01844 | 1/1995 | WIPO . |

OTHER PUBLICATIONS

International Search Report for PCT/US96/16609.

*Primary Examiner*—David A. Simmons
*Assistant Examiner*—Robert R. Koehler
*Attorney, Agent, or Firm*—Kenneth J. Stachel

[57] ABSTRACT

The composition of a non-chrome post-rinse composition for treating phosphated metal substrates is disclosed. The composition comprises the reaction product of an epoxy-functional material containing at least two epoxy groups; and an alkanolamine, or a mixture of alkanolamines. The composition further comprises a group IV-B metal ion, or a mixture of group IV-B metal ions. Also provided is a non-chrome post-rinse concentrate; a process for treating a phosphated metal substrate comprising contacting said phosphated metal substrate with the non-chrome post-rinse composition described above; and the coated article prepared by this process.

8 Claims, No Drawings

NON-CHROME POST-RINSE COMPOSITION FOR PHOSPHATED METAL SUBSTRATES

This is a divisional of U.S. patent application Ser. No. 08/546,024, filed Oct. 20, 1995, now U.S. Pat. No. 5,653, 823.

BACKGROUND OF THE INVENTION

The present invention relates to non-chrome passivating compositions employed as post-rinses in the preparation of phosphated metal substrates. Post-rinses or sealers enhance the corrosion resistance of metal substrates, particularly those that have been pretreated with phosphate conversion coatings. In the past many post-rinse compositions contained chromic acid. To further develop the post rinse technology considering environmental and safety areas from a formulation viewpoint rather than a processing viewpoint, it is desirable to replace those post-rinses with chromic acid with non-chrome post-rinses.

Post rinse technology has utilized certain solubilized metal ions other than chromium to enhance the corrosion resistance of phosphated metal substrates as shown in U.S. Pat. Nos. 3,966,502 and 4,132,572. U.S. Pat. No. 3,966,502. These metal ions can include: water-soluble zirconium salt, and fluorophosphate salt or a mixture of fluorophosphate salts. Also the technology has utilized in rinse compositions such organic, polymeric or nitrogen-containing materials as vegetable tannin, poly-4-vinylphenol or a derivative thereof, and a derivative of a polyalkenylphenol, all of which are used along with other specific components. Such rinse compositions as shown in U.S. Pat. Nos. 3,975,214; 4,376, 000; and 4,517,028, respectively, provide enhancement of the corrosion resistance of phosphated metal substrates.

Several examples of rinse compositions with various specific combinations of components are available in the art. For example, the rinse composition of U.S. Pat. No. 3,615, 895 has an aqueous alkali metal silicate solution prepared from the metal oxide of sodium or potassium; and a water soluble quaternary nitrogen compound having at least one nonhydroxylated alkyl group. Another example of an aqueous rinse composition is disclosed in U.S. Pat. No. 3,912, 548 which has ammonium zirconium carbonate and ammonium fluorozirconate; and polyacrylic acid, esters, and salts thereof. U.S. Pat. No. 4,110,129 discloses an aqueous rinse composition with titanium ion and an adjuvant material selected from the group consisting of phosphoric acid, phytic acid, tannin, the salts or esters of the foregoing, and hydrogen peroxide. U.S. Pat. No. 4,457,790 discloses a rinse composition comprising a metal ion selected from the group consisting of titanium, hafnium and zirconium and a mixture thereof; and a polymeric material which is a derivative of a polyalkenylphenol. Also U.S. Pat. No. 5,209,788 discloses a method of treating metal substrates with an aqueous rinse composition comprising a Group IV-B metal compound from the Periodic Table of Elements; and an amino acid or an amino alcohol.

Many of the non-chrome rinses previously used or described in the post rinse technology do not match the performance of chromic acid rinses. The present invention provides a novel non-chrome post-rinse composition that can more closely match the performance of chromic acid rinses over commercially popular substrates.

SUMMARY OF THE INVENTION

In accordance with the present invention, a non-chrome post-rinse composition is provided for treating phosphated metal substrates comprising: a) the reaction product of an epoxy-functional material having at least two epoxy groups; and an alkanolamine, or a mixture of alkanolamines; and b) a Group IV-B metal ion from the Periodic Table of Elements, or a mixture of such Group IV-B metal ions.

Also provided is a non-chrome post-rinse concentrate for preparing the aqueous non-chrome post-rinse composition by dilution with water. Another aspect of the invention is a process for treating phosphated metal substrates comprising contacting them with the non-chrome post-rinse composition described above; and the coated article prepared by this process.

DETAILED DESCRIPTION

The present invention provides non-chrome post-rinse compositions prepared from epoxy polymeric compounds with the group IVB metal ion to improve the corrosion resistance of phosphated metal substrates, and they can match the performance of chromic acid rinses in corrosion resistance tests.

Though not intending to be bound by any particular theory, it is believed that several theories are applicable to the present invention. It is believed that for species at roughly equal molecular weights, the reaction product has improved adhesion when the epoxy-functional material contains more than two epoxy groups, and contains aromatic or cycloaliphatic functionality. Further, the epoxy-functional materials should be relatively more hydrophobic than hydrophilic in nature. It is believed that adhesion to phosphated metal substrates improves when aromatic or cycloaliphatic groups are present on the epoxy containing materials and when increasing numbers of epoxy groups are present. Also it is further theorized that the hydrophobic materials are less easily rinsed away than hydrophilic materials upon rinsing of phosphated metal substrates treated with the non-chrome post-rinse compositions of the present invention with deionized water prior to drying of the treated substrates.

Among the epoxy-functional materials that can be used are polyglycidyl ethers of alcohols or phenols; epoxy-functional acrylic polymers; polyglycidyl esters of polycarboxylic acids; epoxidized oils; epoxidized melamines; and similar epoxy-functional materials known to those skilled in the art;

Polyglycidyl ethers of alcohols or phenols are prepared from aliphatic alcohols or, preferably, polyhydric phenols. Examples of suitable aliphatic alcohols are ethylene glycol; diethylene glycol; pentaerythritol; trimethylol propane; 1,4-butylene glycol; and the like. Mixtures of alcohols are also suitable. Examples of suitable polyhydric phenols include aromatic species such as 2,2-bis(4-hydroxyphenol)propane (bisphenol A); 3-hydroxyphenol (resorcinol); and the like. Cycloaliphatic polyols can also be used, for example 1,2-cyclohexanediol; 1,2-bis(hydroxymethyl)cyclohexane; hydrogenated bisphenol A; and the like. Also suitable are the novolak resins, that is, resinous reaction products of epichlorohydrin with phenolformaldehyde condensates. These epoxidized novolaks may contain at least two epoxy groups per molecule, and epoxidized novolaks having up to 7 to more epoxy groups are commercially available.

In the preferred embodiment of the invention, the epoxy-functional material is the diglycidyl ether of bisphenol A, commercially available from Shell Chemical Company as EPON 828 epoxy resin, which is a reaction product of epichlorohydrin and 2,2-bis (4-hydroxyphenyl)propane (bisphenol A) which has a molecular weight of about 400, and an epoxide equivalent (ASTM D-1652) of about 185–192.

Examples of epoxy-functional acrylic polymers include copolymers of ethylenically unsaturated acrylic monomers having at least one epoxy group. Examples include glycidyl methacrylate; glycidyl acrylate; allyl glycidyl ether, (3,4-epoxycyclohexyl)-methyl acrylate and the like monoepoxy monomers known to those skilled in the art. Mixtures of these monomers are suitable as well. Typically, other polymerizable ethylenically unsaturated monomers are co-reacted with the epoxy-functional acrylic monomers. This serves to prevent gellation during the polymerization, or to modify the properties of the epoxy-functional acrylic polymer. Examples of other such monomers that could be used include: vinyl aromatic compounds such as styrene and vinyl toluene; nitriles such acrylonitrile and methacrylonitrile; vinyl and vinylidene halides such as vinyl chloride and vinylidene fluoride and vinyl esters such as vinyl acetate, acrylic acid, methacrylic acid, hydroxyethyl acrylate, hydroxyethyl methacrylate; hydroxypropyl acrylate; hydroxypropyl methacrylate; butyl acrylate; 2-hydroxypropyl methacrylate; allyl glycidyl ether; and the like including mixtures thereof. Generally, any amount of these such other monomers can be used, provided the resulting polymer contains at least two epoxy groups.

Polyglycidyl esters of polycarboxylic acids are formed from the reaction of polycarboxylic-acids with an epihalohydrin such as epichlorohydrin. The polycarboxylic acid can be formed by the reaction of alcohols with anhydrides using methods well known to those skilled in the art. Preferably, the alcohol is a diol, or any higher functional polyalcohol. For example, trimethylol propane or pentaerythritol could be reacted with phthalic anhydride or hexahydrophthalic anhydride to produce a polycarboxylic acid that could be further reacted with epichlorohydrin to produce a polyglycidyl ester containing aromatic or cycloaliphatic functionality.

Drying oils that have been epoxidized can be used as well. Examples of suitable drying oils include linseed oil, tung oil, and the like. Preferably, the oils have an epoxy equivalent weight of up to about 400, more preferably from about 150 to about 300, as measured by titration with perchloric acid using methyl violet as an indicator; and a carbon chain length of less than about 30 carbon atoms, preferably less than about 20 carbon atoms. Such materials are commercially available from Witco Chemical Company under the trade name DRAPEX®. These materials include epoxidized soybean oils like epoxidized 2-ethylhexyl tallowcarboxylate, the epoxidized fatty oils can have 8 to 22 carbon atoms like tall oil for the epoxidized 2-ethylhexyltallow oil and cocoamides such as cocodiethanolamide. An example of a preferred material is DRAPEX 10.4, which is an epoxidized linseed oil with an epoxy equivalent weight of 172 and a carbon chain length of about 18, as reported by the manufacturer.

Also suitable are epoxidized aminoplast resins having at least two epoxy groups. Suitable such epoxy resins include those defined by the following structural formula:

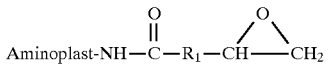

Aminoplast-NH—C—$R_1$—Ch——$CH_2$ wherein $R_1$ represents $(CH_2)m_2$, $m_2$ being an integer ranging from 1 to 2. preferably 1. The aminoplast can be any thermosetting resin prepared from the reaction of an amine with an aldehyde such as melamine resins and urea-formaldehyde resins. An example of a preferred material is an epoxidized melamine resin with an average functionality of six, commercially available from Monsanto Company as LSE-120 Light Stable Epoxy.

Also mixed aliphatic-aromatic epoxy resins which can be used with the present invention are prepared by the well-known reaction of a bis(hydroxy-aromatic) alkane or a tetrakis-(hydroxyaromatic)-alkane with a halogen-substituted aliphatic epoxide in the presence of a base such as, e.g., sodium hydroxide or potassium hydroxide. After hydrogen halide is eliminated under these conditions, the aliphatic epoxide group is coupled to the aromatic nucleus by an ether linkage. Epoxide groups subsequently condense with the hydroxyl groups to form polymeric molecules. Instead of epichlorohydrin, halogen-substituted aliphatic epoxides containing about 4 or more carbon atoms, generally about 4 to about 20 carbon atoms can be used. Epichlorohydrin is the material of choice because of its commercial availability.

Mixtures of epoxy-functional materials representing all the classes described above can also be used.

The epoxy-functional material is reacted with either an alkanolamine, or a mixture of alkanolamines. Preferably, primary or secondary alkanolamines, or mixtures thereof are used. Tertiary alkanolamines or mixtures thereof are also suitable, but the reaction conditions differ when these materials are used. Consequently, tertiary alkanolamines are not typically mixed with primary or secondary alkanolamines.

The preferred alkanolamines have alkanol groups containing fewer than about 20 carbon atoms, more preferably, fewer than about 10 carbon atoms. Examples include methyl ethanolamine; ethylethanolamine, diethanolamine, methyliso-propanolamine, ethylisopropanolamine, diisopropanolamine, monoethanolamine, and diisopropanolamine and the like. Diethanolamine is particularly preferred. If tertiary alkanolamines are to be used, it is preferred that they contain two methyl groups. An example of suitable material is dimethylethanolamine, which is the preferred tertiary alkanolamine.

The epoxy-functional material and the alkanolamines are reacted in a equivalent ratio of from about 5:1 to about 1:4, preferably from about 2:1 to about 1:2.

The epoxy-functional material and the alkanolamines can be co-reacted by any of the methods well known to those skilled in the art of polymer synthesis, including solution, emulsion, suspension or dispersion polymerization techniques. In the simplest cases, the alkanolamine is added to the epoxy-functional material at a controlled rate, and they are simply heated together, usually with some diluent, at a controlled temperature. Preferably the reaction is conducted under a nitrogen blanket or another procedure known to those skilled in the art for reducing the presence of oxygen during the reaction.

The diluent serves to reduce the viscosity of the reaction mixture. Preferred diluents are water-dispersible organic solvents. Examples include alcohols with up to about eight carbon atoms, such as methanol or isopropanol, and the like; or glycol ethers such as the monoalkyl ethers of ethylene glycol, diethylene glycol, or propylene glycol, and the like. The glycol ethers are preferred. Water is also a suitable diluent.

Other suitable diluents include nonreactive oligomeric or polymeric materials with a viscosity ranging from about 20 centipoise to about 1,000 centipoise, as measured with a Brookfield viscometer at about 72° F.; and a glass transition temperature lower than about 35° C., as measured by any of the common thermal analytical methods well known by those skilled in the art. Examples include plasticizers such as tributyl phosphate, dibutyl maleate, butyl benzyl phthalate, and the like known to those skilled in the art; and silane compounds such as vinyl trimethoxy silane, gamma-methacryloxypropyl trimethoxy silane, and the like known to those skilled in the art. Mixtures of any of these alternative diluents, water, or organic solvents are suitable as well.

If a tertiary alkanolamine is used, a quaternary ammonium compound is formed. In this case, it is the usual practice to add all the raw materials to the reaction vessel at once and heat them together, usually with some diluent, at a controlled temperature. Typically, some acid is present, which serves to ensure that a quaternary ammonium salt is formed instead of a quaternary ammonium oxide. Examples of suitable acids are carboxylic acids such as lactic acid, citric acid, adipic acid, and the like. Acetid acid is preferred. The quaternary ammonium salts are preferred because these are more easily dispersed in water, and because they produce an aqueous dispersion with a pH in or near the desired range. If, instead, a quaternary ammonium oxide is prepared, it can later be converted to a quaternary ammonium salt with the addition of acid.

The reaction product of the epoxy-functional material and the alkanolamines as described above is referred to hereinafter and in the claims appended hereto as "Epoxy Reaction Product". The molecular weight of Epoxy Reaction Product is limited only by its dispersibility in the other materials comprising the non-chrome post-rinse composition. The dispersibility of the Epoxy Reaction Product is determined, in part, by the nature of the epoxy-functional material, the nature of the alkanolamine, and the equivalent ratio in which the two are reacted. Typically, the Epoxy Reaction Product has a number-average molecular weight of up to about 1500, as measured by gel permeation chromatography using polystyrene as a standard.

Optionally, the Epoxy Reaction Product can be neutralized to promote good dispersion in an aqueous medium. Typically, this is accomplished by adding some acid. Examples of suitable neutralizing acids include lactic acid, phosphoric, acetic acid, and the like known to those skilled in the art.

The Epoxy Reaction Product is present in the non-chrome post-rinse composition at a level of at least about 100 ppm, preferably, from about 400 ppm to about 1400 ppm, the concentration based on the solid weight of the Epoxy Reaction Product on the total weight of the non-chrome post-rinse composition.

Also present in the non-chrome post-rinse composition is a group IV-B metal ion or a mixture of group IV-B metal ions. The group IV-B metals are defined by the CAS Periodic Table of the Elements as shown, for example, in the *Handbook of Chemistry and Physics,* 63d Edition (1983). The group includes zirconium, titanium and hafnium. Zirconium is preferred.

Typically, group IV-B metal ions are added in the form of metal salts or acids because in these forms, the metal ions are water-soluble. For example, zirconium ions can be added in the form of alkali metals or ammonium fluorozirconates, zirconium carboxylates or zirconium hydroxy carboxylates. Specific examples include zirconium acetate, ammonium zirconium glycolate, and the like materials known to those skilled in the art. Fluorozirconic acid is preferred. If titanium is to be used as the group IV-B metal ion, preferably it is added as fluorotitanic acid. Because of its relative expense, hafnium is not preferred.

The group IV-B metal ions are added at a level of up to about 2,000 ppm. If zirconium is to be used, the preferred level is from about 75 ppm to about 225 ppm; if titanium is to be used, the preferred level is from about 35 ppm to about 125 ppm; and if hafnium is to be used, the preferred level is from about 150 ppm to about 500 ppm. The concentrations are based on the weight of the metal ion on the weight of the non-chrome post-rinse composition, and "ppm" stands for parts per million.

Optionally, other metal ions might be present in the non-chrome post-rinse composition as non-essential ingredients, for example, zinc, iron, manganese, nickel, aluminum, cobalt, calcium, sodium, potassium, or mixtures thereof. These metal ions can be present from the addition of any compounds known to those skilled in the art for providing such metal ions in a noninterfering manner in aqueous solutions.

Typically, water-soluble or water-dispersible acids and bases are used to adjust the pH of the non-chrome post-rinse composition to a level of from about 3.5 to about 5.5, preferably from about 4.0 to about 4.7. Suitable acids include mineral acids such as hydrofluoric acid, fluoroboric acid, fluorosilicic acid, phosphoric acid, or mixtures thereof; or organic acids such as lactic acid, acetic acid, hydroxyacetic acid, citric acid, or mixtures thereof. Mixtures of mineral acids and organic acids are suitable as well. Nitric acid is preferred. Suitable bases include inorganic metal salts such as sodium hydroxide or potassium hydroxide, or mixtures of inorganic metal salts. Water-soluble or water-dispersible nitrogen-containing compounds are also suitable bases. Examples include ammonia; or amines such as triethylamine, methyl ethyl amine, or diisopropanolamine; or mixtures thereof. Mixtures of inorganic metal salts and nitrogen-containing compounds are suitable as well. Sodium hydroxide is preferred.

Other optional materials that could be present include water-dispersible organic solvents, for example alcohols with up to about eight carbon atoms such as methanol, isopropanol, and the like known to those skilled in the art; or glycol ethers such as the monoalkyl ethers of ethylene glycol, diethylene glycol, or propylene glycol, and the like known to those skilled in the art. When present, water-dispersible organic solvents are typically used at a level of up to about ten percent, the percentage based on the volume of solvent in the total volume of the non-chrome post-rinse composition.

Also, the non-chrome post-rinse composition can optionally contain surfactants that function as defoamers or as aids for improving substrate wetting. Anionic, cationic, amphoteric, or non-ionic surfactants can be used. Mixtures of these materials are also suitable, provided there is no incompatibility. In other words, anionic and cationic surfactants are typically not mixed together. Non-ionic surfactants are preferred.

Examples of suitable anionic surfactants include sodium lauryl sulfate; ammonium nonylphenoxy (polyethoxy)$_{6-60}$ sulfonate; and the like known to those skilled in the art. Examples of suitable cationic surfactants include tetramethyl ammonium chloride; ethylene oxide condensates of cocoamines; and the like known to those skilled in the art. Examples of suitable amphoteric surfactants include disodium N-lauryl amino propionate; sodium salts of dicarboxylic acid coconut derivatives; betaine compounds such as lauryl betaine; and the like known to those skilled in the art.

Examples of the preferred non-ionic surfactants include nonylphenoxy (polyethoxy)$_{6-60}$ ethanol; ethylene oxide derivatives of long chain acids; ethylene oxide condensates of long chain alcohols; and the like. Two non-ionic surfactants that are particularly preferred for use as defoamers are ADVANTAGE® DR285 and SURFYNOL® DF110L. The former is polypropylene glycol which is commercially available from Hercules Chemical Company. The SURFYNOL® DF110L, is a higher molecular weight acetylenic polyethylene oxide liquid, nonionic, surfactant having a hydrophilic-lipophilic balance (HLB) of 3.0 which is available from Air Products & Chemicals, Inc.

Generally, these surfactant materials with defoamer functionality are used at levels of up to about one percent, preferably up to about 0.10%; and, optionally wetting aids can be used at levels of up to about two percent, preferably up to about 0.5%. The percentages are based on the volume of surfactant on the total volume of the non-chrome post-rinse composition.

The non-chrome post-rinse composition of the present invention is prepared by diluting the Epoxy Reaction Product described above and any other ingredients that will be used in water under gentle agitation. Preferably, deionized water is used. Alternatively, a non-chrome post-rinse concentrate can be prepared first. Typically, this is done by premixing all the ingredients using little or no water. The concentrate can be stored until just before it is to be applied, wben it is diluted with water.

In the preferred embodiment, the non-chrome post-rinse composition is prepared from the Epoxy Reaction Product of EPON 828 and diethanolamine, and is present at a level of from about 400 ppm to about 1400 ppm, the level based on the solid weight of the Epoxy Reaction Product on the total weight of the non-chrome post-rinse composition. Zirconium ions are present, added as fluorozirconic acid, at a level of from about 75 ppm to about 225 ppm, the level based on the total weight of the non-chrome post-rinse composition. SURFYNOL DF15 1OL surfactant is used as a defoamer at about 0.1% volume/volume. The monomethyl ether of dipropylene glycol is also present, at a level of up to about 1% volume/volume. Also in the preferred embodiment, the pH of the non-chrome post-rinse composition is adjusted to about 4.0 to 4.7 with aqueous solutions of nitric acid and sodium hydroxide. A material representing the preferred embodiment is shown in Example 1, below.

Another aspect of the present invention is a process for treating phosphated metal substrates by contacting them with the non-chrome post-rinse composition described above. The nonchrome, post-rinse of the present invention is suitable for treating phosphate layers of all types know to those skilled in the art which can be formed on metals, particularly on steel, for example, cold rolled steel, hot dip galvanized metal, electrogalvanized metal, galvaneal, steel plated with a zinc alloy, aluminum-plated steel, zinc, zinc alloys, aluminum and aluminum alloy substrates. Suitable phosphate conversion coatings that are present on these substrates are generally any of those known to those skilled in the art. For instance those such as, inter alia, zinc phosphate, iron phosphate, manganese phosphate, calcium phosphate, magnesium phosphate, nickel phosphate, cobalt phosphate, zinc-iron phosphate, zinc-manganese phosphate, zinc-nickel phosphate, zinc-calcium phosphate, zinc-nickel-manganese phosphate, and layers of other types, which contain one or more multi-valent cations. Usually, the most pronounced effect can be seen when using cold rolled steel to which an iron phosphate conversion coating has been applied. Other phosphate layers can be used such as those formed by low-zinc phosphating processes. Such iron phosphate or low zinc phosphate conversion coatings can be with or without the addition of other cations, such as Mn, Ni, Co, and Mg.

Phosphate conversion coating processes known to those skilled in the art are appropriate for preparing the phosphated metal substrate to which the rinse solution of the present invention can be applied. Generally these processes have numerous steps depending on the composition of the substrate and the subsequent coatings to be applied to the rinse treated substrate. Typically in conversion coating processes there can be anywhere from two to nine steps. For instance, a five step process can include the metal being cleaned, rinsed with water, coated with a conversion coating, rinsed with water, and rinsed with a post rinse formulation. Such a process can be altered by the addition of steps and/or the addition of various components to one or more steps to reduce the number of steps. For instance, additional rinse steps between chemical treatment steps can be used for treatment of substrates with complex shapes and/or surfactants can be employed in the conversion coating step to perform both cleaning and coating in the same step. Examples of such multi-step processes are iron phosphating with generally five steps and zinc phosphating with generally a minimum of six steps.

After the conversion layer has been produced, any surplus treatment solution can be removed from the surface as far as possible. This can be done, for example, by drip-drying, squeezing, draining or rinsing with water or an aqueous solution which can be adjusted to be acidic, for example, with an inorganic or organic acid, (hydrofluoric acid, boric acid, nitric acid, formic acid, acetic acid, etc.). After formation of the conversion layer, the so treated metal surface is ready for the rinsing step.

The non-chrome post-rinse composition can be applied by various techniques such as dipping, immersion, spraying, flooding, or rolling well known to those skilled in the art of metal pretreatment. The rinse time should be as long as would ensure sufficient wetting of the phosphated metal substrate. Typically, the rinse time is from about five seconds to about ten minutes, preferably from about 15 seconds to about one minute. The rinse is typically applied at a temperature of from about 5° C. to about 100° C., preferably from about 20° C. to about 60° C.

Usually, a water rinse is applied after the non-chrome post-rinse composition has been applied. Preferably, deionized water is used. Typically, the treated metal substrate is at this point ready for electrodeposition coating of a primer or additional layers of coatings. Alternatively, the treated metal substrate can be dried, either by air-drying or by forced drying. Typically, a protective or decorative coating or paint is applied to the phosphated metal substrate after it has been treated as set forth above.

Illustrating the invention are the following non-limiting examples.

EXAMPLES

In accordance with the present invention, the following examples show the preparation of various non-chrome post-rinse compositions and their application to phosphated metal substrates. For the purposes of comparison, deionized water, chrome-containing post rinse compositions, and non-chrome post-rinse compositions representing the prior art were also applied to phosphated metal substrates.

In all the examples, ambient temperature was about 20°–30° C. Weight percent solids were determined at 110° C. for one hour. The acid value or milliequivalents of acid were measured by titration with methanolic potassium hydroxide using phenolphthalein as an indicator. The milliequivalents of base, nitrogen or quaternary ammonium were measured by titration with aqueous hydrochloric acid using methyl violet as an indicator. The pH was measured at ambient temperature using a Digital Ionalyzer Model #501, commercially available from Orion Research.

Example 1

PREPARATION OF THE PREFERRED NON-CHROME POST-RINSE COMPOSITION

First, an aromatic epoxy-functional material was reacted with diethanolamine in an equivalent ratio of 1:2. The following materials were used:

| MATERIAL | AMOUNT |
|---|---|
| EPON 828[1] | 376 grams |
| DOWANOL PM[2] | 586 grams |
| Diethanolamine | 210 grams |
| TOTAL | 1172 grams |

[1]The diglycidyl ether of bisphenol A, commercially available from Shell Chemical Company.
[2]The monomethyl ether of propylene glycol, commercially available from Dow Chemical Company.

The EPON 828 and the DOWANOL PM were added to a two liter round bottom flask fitted with a nitrogen sparge line. The mixture was sparged with nitrogen for five minutes, then the sparge line was removed and the flask was fitted with a cap. The reaction mixture was heated to 50° C., then the diethanolamine was added. There was an exotherm which elevated the temperature to 92° C. after 30 minutes. The reaction mixture was then heated to 100° C. and held for two hours Next, reaction mixture was cooled and filtered to produce a Epoxy Reaction Product at 51.16 weight percent solids. The milliequivalents of nitrogen were measured at 1.668.

A non-chrome post-rinse composition was prepared from the following materials:

| MATERIAL | AMOUNT |
|---|---|
| Reaction Product Prepared Above | 38 ml |
| 5% Fluorozirconic Acid | 9.4 ml |

The composition was prepared by adding the reaction product and the fluorozirconic acid to a portion of tap water with agitation. Enough tap water was used to bulk the volume to 19 liters. The pH was then adjusted to a final value of 4.57 using 10 ml of 1.5 molar nitric acid.

EXAMPLES 2–8

Additional examples of the formation of reaction product are shown in Table I, where the method for the preparation of the reaction product was similar to that of Example 1 except as here noted. The reaction products were formulated into non-chrome post-rinse compositions. In Examples 2–4 the reaction products were from an aromatic epoxy and various alkanolamines including: methyl ethanolamine, diethanolamine, and monoethanolamine. In Examples 5–8, the reaction products were from diethanolamine and various epoxy materials including: aliphatic epoxy prepared from a drying oil, aliphatic epoxy prepared from a triol, aromatic epoxy prepared from an epoxidized melamine. In Table I below the temperature 1 and temperature 2 are, respectively, the temperature to which the mixture of epoxy material, solvent, and deionized water, if any, are heated, and the temperature after the addition of the alkanolamine with the exotherm after the indicated time period.

For example 3 after the exotherm from the addition of the alkanolamine, a one-gram sample of the reaction mixture diluted in 10 grams of deionized water was clear, but difficult to disperse. The reaction mixture was cooled to 100° C. and held for 2½ hours at which time a one-gram sample of the reaction mixture was diluted in 10 grams of deionized water and was clear and easily dispersed. A second portion of deionized water was added. The reaction mixture was then cooled and filtered to produce a reaction product at 46.78 weight percent solids. The milliequivalents of acid were measured at 0; the milliequivalents of base were measured at 1.974; and the milliequivalents of quaternary hydroxide were measured at 0.420.

For Examples 4, 5, 6, 7 and 8 the monoethanolamine or diethanolamine and the first portion of DOWANOL PM were added to a two liter round bottom flask fitted with a nitrogen sparge line (one liter for example 4). The mixture was sparged with nitrogen for five minutes, then the sparge line was removed and the flask was fitted with a cap. The reaction mixture was heated to 100° C., then the EPON 828 or EPONEX 1511 or DRAPEX 10.4 or HELOXY modifier 44 or LSE 120 and the second portion of DOWANOL PM were added in a continuous manner over two hours. There was an exotherm which elevated the temperature to 120° C. in 50 minutes. The reaction mixture was cooled to 100° C. for the remaining hour of the feed. After the second charge was completely added, the reaction mixture was held for an additional two hours at 100° C. The reaction mixture was then cooled and filtered to produce a reaction product. For example 6 after heating at 100° C. for three hours after the second charge was added the epoxy equivalent weight was measured at 517. The reaction mixture was heated to 120° C. and held for an additional two hours, at which time the epoxy equivalent weight was measured at 561. After another hour at 120° C., the reaction mixture was heated to 140° C. and held for an additional ten hours, at which time the epoxy equivalent weight was measured at 857. The reaction mixture was then cooled and filtered to produce a reaction product.

TABLE I (PREPARATION OF EPOXY REACTION PRODUCT)

| | 2 | 3 | 4 | 5 | 6 | 7[3] | 8[5] |
|---|---|---|---|---|---|---|---|
| Example # | | | | | | | |
| 1. material (gm.) | | | | | | | |
| A) Epoxy | | | | | | | |
| EPON 828 | 376 | 376 | 376 | | | | |
| DRAPEX[1] 10.4 | | | | | 344 | | |
| HELOXY ® | | | | | | 165 | |

TABLE I-continued (PREPARATION OF EPOXY REACTION PRODUCT)

| | 2 | 3 | 4 | 5 | 6 | 7[3] | 8[5] |
|---|---|---|---|---|---|---|---|
| Modifier 44[2] | | | | | | | |
| LSE-120[4] | | | | | | | 533.3 |
| EPONEX ® 1511[6] | | | | 444 | | | |
| DOWANOL PM (gm.) | 526 | 66.5 | 125.3 | 148 | 344 | 165 | 106.7 |
| deionized H2O | | 72 | | | | | |
| B) Alkanolamine | | | | | | | |
| Diethanolamine | | | | 210 | 105 | 105 | 105 |
| Methyl Ethanol-amine | 150 | | | | | | |
| Monoethanol-amine | | | 122 | | | | |
| dimethyl-ethanol-amine | | 178 | | | | | |
| DOWANOL PM | | | 40.7 | 70 | 105 | 105 | 105 |
| deionized H2O | | 415.8 | | | | | |
| 2) equiv ratio | 1:2 | 1:2 | 1:2 | 1:2 | 1:2 | 0.333:1 | 0.167:1 |
| 3) TOTAL Weight (grams) | 1052 | 1106 | 664 | 872 | 898 | 540 grams | 850 |
| 4) temperature 1 (°C.) | 54 | 49 | 100 | 100 | | | |
| 5) temperature 2 (°C.) /min | 116/5 | 111/ immediately | 120/50 | | | | |
| 6) wt % solids | 50.38 | 46.78 | 72.82 | 75.11 | 49.01 | 50.19 | 50.23 |
| 7) meq N2 | 1.853 | 1.974 | 2.929 | 2.263 | 0.44 | 1.836 | 1.119 |

[1]An epoxidized linseed oil with an epoxy equivalent weight of 172 and a carbon chain length of about 18, commercially available from Witco Chemical Company.
[2]The triglycidyl ether of trimethylolethane, commercially available from Shell Chemical Company.
[3]The reaction mixture was heated to 100° C., then the HELOXY Modifier 44 and the second portion of DOWANOL PM were added in a continuous manner over two hours. The temperature was held at 100° C. for an additional two hours, then the reaction mixture was then cooled and filtered
[4]An epoxidized melamine, commercially available from Monsanto Company.
[5]The reaction mixture was heated to 100° C., then the LSE-100 and the second portion of DOWANOL PM were added in a continuous manner over two hours.
[6]Hydrogenated EPON 828, commercially available from Shell Chemical Company.
meq N2 = milliequivalents of nitrogen The reaction products of Table I were formulated into rinse concentrates and/or compositions as indicated in Table II where the method of preparation was similar to that for Example 1 except where noted. The nitric acid or nitric acid and one molar sodium hydroxide were used to adjust the pH to the indicated value.

For Examples 3, 5, 7, 9, and 10, the concentrate was prepared by adding the fluorozirconic acid to the reaction product with agitation, and then adding a portion of deionized water to thin the viscosity of the mixture. Next, the nitric acid was added, followed by a second portion of deionized water. The total amount of deionized water used was enough to bulk the final volume of the concentrate to 200 ml for example 3 and 250 ml for Examples 5, 7, 9 and 10. A non-chrome post-rinse composition was made by diluting the concentrate prepared above to a 1% volume/volume mixture with tap water.

For example 4 the concentrate was prepared by adding the Dowanol PM to the reaction product with agitation. The fluorozirconic acid was added next, followed by a portion of deionized water to thin the viscosity of the mixture. Finally the nitric acid was added, followed by a second portion of deionized water. The total amount of deionized water used was enough to bulk the final volume of the concentrate to 150 ml. A non-chrome post-rinse composition was made by diluting the concentrate prepared above to an 0.6w volume/volume mixture with tap water.

For Example 6 the concentrate was prepared by adding the Dowanol DPM to the reaction product with agitation. The fluorozirconic acid was then added. Finally, enough deionized water was added to bulk the final volume of the concentrate to 250 ml. A non-chrome post-rinse composition was made by diluting the concentrate prepared above to an 0.5% volume/volume mixture with tap water. The pH was then adjusted to final value of 4.32 using 10 ml of 1 molar sodium hydroxide.

For Example 8 the concentrate was prepared by adding the fluorozirconic acid to the reaction product with agitation, and then adding the nitric acid. Next, a portion of deionized water was added to thin the viscosity of the mixture. Finally the Dowanol PM was added, followed by a second portion of deionized water. The total amount of deionized water used was enough to bulk the final volume of the concentrate to 250 ml. A non-chrome post-rinse composition was made by diluting the concentrate prepared above to a 1% volume/volume mixture with tap water. The pH was then adjusted to a final value using 15 ml of 1 molar sodium hydroxide.

TABLE II (PREPARATION OF RINSE CONCENTRATES AND RINSE SOLUTIONS)

| Components | 2 | 3 | 4 | 5 | 6 | 7 | 8 | 9 | 10 |
|---|---|---|---|---|---|---|---|---|---|
| Reaction Product from | 2/ | 3/ | 4/ | 5/ | 6/ | 7/ | 8/ | 1/ | 1/ |

TABLE II-continued (PREPARATION OF RINSE CONCENTRATES AND RINSE SOLUTIONS)

| Components | 2 | 3 | 4 | 5 | 6 | 7 | 8 | 9 | 10 |
|---|---|---|---|---|---|---|---|---|---|
| Example of Table 1 (/amount) | 38 ml | 40 gms. | 33 gms | 50 gms. | 100 gms. | 50 gms. | 50 grams | 50 gms. | 50 gms |
| Dowanol PM | | | 42 ml | | | | 50 ml | | |
| Dowanol DPM | | | | | 50 gms | | | | |
| Fluorozirconic Acid[1] | 9.4 ml | 10 ml | 12.5 ml | 12.5 ml | 25 ml | 12.5 ml | 12.5 ml | 12.5 ml | |
| Fluorotitanic acid[5] | | | | | | | | | 11.3 gms. |
| nitric acid[4] | | 2.6 ml | 3 ml | 2.3 ml | | 2.5 ml | 2.5 ml | 0.5 | 1.0 ml |
| concentrate volume (ml) | | 200 ml | 150 ml | 250 ml | 250 ml | 250 ml | 250 ml | 250 | 250 |
| Ratio of conc to tap water (% v/v) | | 1 | 0.6 | 1 | 0.5 | 1 | 1 | 1 | 1 |
| nitric[2] pH adjust | 31 ml | | | | 10 ml[3] | | 15 ml[3] | 10 ml | 11 ml[3] |
| pH of comp | 4.75 | 4.39 | 4.18 | 4.39 | 4.32 | 4.78 | 4.28 | 4.65 | 4.65 |

[1]At 45 percent concentration.
[2]At 1.5 molar
[3]1.0 molar sodium hydroxide
[4]At 67 percent concentration
[5]At 60 percent concentration
conc = concentrate

PANEL PREPARATION FOR CORROSION RESISTANCE TESTING

The corrosion resistance produced by various post-rinse compositions is shown in Table III. Corrosion resistance was measured according to ASTM B117, entitled "Standard Test Method of Salt Spray (Fog) Testing."

For each test, 4×12-inch cold rolled steel test panels were treated with Chemfos® 51, a pretreatment composition that is commercially available from PPG Industries, Inc. This pretreatment composition simultaneously cleans the steel and deposits an iron phosphate conversion coating. The pretreatment composition was applied as a three percent volume/volume aqueous solution. The Chemfos 51 was heated to 60°–63° C., then spray-applied for one minute. Triton® X-100 and Triton CF-32 nonionic surfactants, commercially available from Union Carbide Corporation, were added to the pretreatment composition as necessary to provide additional cleaning of the steel.

After the pretreatment composition was applied, the test panels were rinsed by either spray or immersion for 30 seconds with tap water held at ambient temperature. Next, the test panels were immersed for 30 seconds in a post-rinse composition held at ambient temperature. Finally, the test panels were rinsed with a spray of deionized water for about 5–10 seconds, then dried for about 5–7 minutes at 135° C. In the cases where the post-rinse composition was deionized water, the second immersion step was omitted and the final water rinse lasted for about 30 seconds instead of about 5–10 seconds.

After the test panels were pretreated, a coating composition was applied to them. FSVH55507, a high solids polyester coating composition commercially available from PPG Industries, Inc., was reduced according to the manufacturer's instructions and spray-applied to a film thickness of 0.8 to 1.2 mils.

The painted test panels were scribed to the metal from corner to corner to form an "X". Typically, three test panels were prepared for each post-rinse composition; for some control materials, only one or two test panels were prepared. The test panels were evaluated after one week of exposure to salt fog. The non-chrome post-rinse compositions were tested in three groups, with a variety of comparative examples included in each test group.

Panels removed from salt spray testing were rinsed in running tap water. Loose paint and corrosion products were scraped from one scribe line with a mildly abrasive pad, and panels were dried with a paper towel. The washed scribe line was then taped with #780 filament tape, and the tape then vigorously pulled at right angles to the panel. Three one-inch segments were measured off from each end of this scribe line. Within each one-inch segment, the total width of delamination at its widest point was measured to the nearest 32nd inch. The measurements were then averaged, and half of that average was then reported as creepback from scribe. The results are given in units of X/32nd of an inch, with a separate result reported for each test panel. A failure indicates greater than 16/32 nd of an inch creepback over the entire length of the scribe.

TABLE III

CORROSION RESISTANCE OVER STEEL WITH VARIOUS POST-RINSE COMPOSITIONS

| TEST GROUP | POST-RINSE COMPOSITION | SALT SPRAY RESULTS X/32's INCH CREEPBACK |
|---|---|---|
| 1 | Deionized Water (COMPARATIVE) | 13, >16, >16 |
| | CHEMSEAL 20[1] (COMPARATIVE) | 3, 3, 4 |
| | CHEMSEAL 19[2] (COMPARATIVE) | 10, 9, 8 |
| | Post Rinse Composition of Example 1 | 4, 5, 7 |
| | Post Rinse Composition of Example 2 | 4, 4, 3 |
| 2 | Deionized Water (COMPARATIVE) | 15, 15 |
| | CHEMSEAL 20 (COMPARATIVE) | 2, 3 |
| | CHEMSEAL 19 (COMPARATIVE) | 11, 11, 10 |
| | Post-Rinse Composition of Example 3 | 7, 8, 9 |
| | Post-Rinse Composition of Example 4 | 2, 2, 1 |
| | Post-Rinse Composition of Example 5 | 2, 3, 1 |
| 3 | Deionized Water (COMPARATIVE) | >16, 15 |
| | CHEMSEAL 20 (COMPARATIVE) | 3, 3 |

TABLE III-continued

| CORROSION RESISTANCE OVER STEEL WITH VARIOUS POST-RINSE COMPOSITIONS | | |
|---|---|---|
| TEST GROUP | POST-RINSE COMPOSITION | SALT SPRAY RESULTS X/32's INCH CREEPBACK |
| | CHEMSEAL 19 (COMPARATIVE) | 10, 13, 8 |
| | Post-Rinse Composition of Example 6 | 7, 6, 6 |
| | Post-Rinse Composition of Example 7 | 6, 5, 6 |
| | Post-Rinse Composition of Example 8 | 5, 4, 4 |
| 4 | Deionized Water (COMPARATIVE) | 15 |
| | CHEMSEAL 20 (COMPARATIVE) | 1 |
| | CHEMSEAL 19 (COMPARATIVE) | 9, 6, 6 |
| | Post-Rinse Composition of Example 9 | 1, 1, 1 |
| | Post-Rinse Composition of Example 10 | 2, 2, 2 |

[1]A mixed hexavalent/trivalent chromium post-rinse composition, commercially available from PPG Industries, Inc. The post-rinse was used at 208 to 277 ppm hexavalent chromium and a pH of 4.0–4.5.
[2]A zirconium post-rinse composition, available from PPG Industries, Inc. The post-rinse was used as a 0.75 percent volume/volume solution at a pH of 4.2–4.7, at ambient temperature.

EXAMPLE 11

PREPARATION OF A NON-CHROME POST RINSE COMPOSITION

An aromatic epoxy-functional material was reacted with diethanolamine in an equivalent ratio of 1:2. The following materials were used:

| MATERIAL | AMOUNT |
|---|---|
| Diethanolamine | 525 grams |
| DOWANOL DPM | 175 grams |
| EPON 828 | 940 grams |
| DOWANOL DPM | 313.5 grams |
| Deionized Water | 976.5 grams |
| TOTAL | 2930 grams |

The diethanolamine and the first portion of DOWANOL PM were added to a three liter round bottom flask fitted with a nitrogen sparge line. The mixture was sparged with nitrogen for five minutes, then the sparge line was removed and the flask was fitted with a cap. The reaction mixture was heated to 100° C., then the EPON 828 and the second portion of DOWANOL PM were added in a continuous manner over two hours. After the second charge was completely added, the reaction mixture was held for an additional two hours at 100° C., then the deionized water was added in a continuous manner over 30 minutes. The reaction mixture was then cooled and filtered to produce a reaction product at 50.97 weight percent solids. The milliequivalents of nitrogen were measured at 1.725.

This reaction product was used to make a non-chrome post rinse concentrate as shown in the table below:

| MATERIAL | AMOUNT |
|---|---|
| Reaction Product of Epoxy and Diethanolamine | 200 grams |
| 45% Fluorozirconic Acid | 50 ml |
| 67% Nitric Acid | 20 ml |

The concentrate was made by mixing the reaction product with a small portion of deionized water to reduce viscosity. The fluorozirconic acid was mixed into the reaction product with moderate agitation, followed by the addition of nitric acid. Subsequently, enough deionized water was added to bring the total volume to one liter. A non-chrome post rinse composition was made by diluting the concentrate prepared above to a 1% volume/volume mixture with tap water. The pH of the solution was adjusted to 4.30 using 1 molar sodium hydroxide solution.

EXAMPLE 12

PREPARATION OF A NON-CHROME POST RINSE COMPOSITION

First, a reaction product of an aromatic epoxy-functional material and diethanolamine was prepared identically to that of example 11. This reaction product was used to make a non-chrome post rinse concentrate as shown in the table below:

| MATERIAL | AMOUNT |
|---|---|
| Reaction Product of Epoxy and Diethanolamine | 189 grams |
| Surfynol ® DF 110L | 2 grams |
| 45% Fluorozirconic Acid | 71 grams |
| 67% Nitric Acid | 23 grams |

The concentrate was prepared by mixing the reaction product with the Surfynol®, and about 200 grams of deionized water was added with mixing along with moderate agitation. The fluorozirconic acid and the nitric acid were added. Enough deionized water was added to bring the concentrate to a total weight of 1000 grams.

A non-chrome post rinse composition was made by diluting the concentrate prepared above to a 1% volume/volume mixture with tap water. The pH of the solution was adjusted to 4.33 using 1 molar sodium hydroxide solution.

PANEL PREPARATION FOR CORROSION RESISTANCE TESTING

The corrosion resistance produced by post-rinse compositions of examples 11 and 12 were measured according to ASTM B117, entitled "Standard Test Method of Salt Spray (Fog) Testing" in a similar manner to the corrosion resistance testing for the post-rinse compositions of Table II. There were several exceptions to the panel preparation procedure noted above for testing. For Test Set "A", shown in Table IV, 4"×12" hot dipped galvanized and aluminum 6061-T6 panels were also processed.

Another exception was for Test Set "B", shown in Table V, where 4×"12" electrogalvanized, galvaneal and electrozinc/iron panels were processed in addition to the cold rolled steel. Panels were cleaned in a Chemkleen 163 medium-duty alkaline cleaner available from PPG Industries Inc. as a ChemFil product. After rinsing, the panels were treated in Chemfos® 158, an iron phosphate pretreatment composition commercially available from PPG Industries, Inc. The pretreatment was sprayed on the panels at 66° C. for one minute at a Total Acid value of 9.6 points and pH of 5.4. The panels were rinsed in ambient tap water and then post rinsed and painted as in the previous panel sets. Test set B also included zinc phosphated panels; one panel of each substrate for each post rinse composition. These panels were cleaned in a standard medium-duty alkaline cleaner, and rinsed in a conditioning rinse. The panels were phosphated by immersion using Chemfos® 700, a zinc phosphate pretreatment composition commercially available from PPG Industries, Inc. The treatment time was two minutes and the temperature was about 52° C. The zinc phosphate was followed by an ambient rinse, then post rinsed and painted as in the previous panel sets.

TABLE IV

| TEST SET A | | | |
|---|---|---|---|
| | SALT SPRAY RESULTS X/32's INCH CREEPBACK | | |
| POST RINSE COMPOSITION | Cold Rolled Stell | Hot Dipped Galvanized | Aluminum 6061-T6 |
| Deionized Water (Comparative) | >16, >16 | >16, >16 | <1, <1 |
| CHEMSEAL 20 (Comparative) | 3, 4 | 14, 13 | <1, <1 |
| CHEMSEAL 19 (Comparative) | 11, 11 | >16, >16 | <1, <1 |
| Post Rinse Composition of Example 11 | 1, 2 | 5, 5 | <1, <1 |

The good corrosion resistance shown on cold rolled steel and hot dipped galvanized steel can be achieved without sacrificing corrosion resistance on aluminum substrates where multiple substrate types are rinsed with the rinse composition of the present invention.

TABLE V

| TEST SET B | | | |
|---|---|---|---|
| POST RINSE | | SALT SPRAY RESULTS X/32's INCH CREEPBACK | |
| COMPOSITION | SUBSTRATE | Iron Phosphate | Zinc Phosphate |
| Deionized Water (Comparative) | Cold Rolled Steel (2 week Salt Spray) | >16, >16, >16 | >16 |
| CHEMSEAL 20 (Comparative) | Cold Rolled Steel (2 week Salt Spray) | 5, 3, 6 | 5 |
| CHEMSEAL 59 (Comparative) | Cold Rolled Steel (2 week Salt Spray) | >16, >16, >16 | >16 |
| Post Rinse Composition of Example 12 | Cold Rolled Steel (2 week Salt Spray) | 4, 5, 7 | 5 |
| Deionized Water (Comparative) | Electro-Zinc/Iron (1 week Salt Spray) | >16, >16, >16 | 8 |
| CHEMSEAL 20 (Comparative) | Electro-Zinc/Iron (1 week Salt Spray) | 1, 3, 2 | 1 |
| CHEMSEAL 59 (Comparative) | Electro-Zinc/Iron (1 week Salt Spray) | >16, >16, >16 | 2 |
| Post Rinse Composition of Example 12 | Electro-Zinc/Iron (1 week Salt Spray) | 2, 2, 3 | <1 |

TABLE V-continued

| TEST SET B | | | |
|---|---|---|---|
| POST RINSE | | SALT SPRAY RESULTS X/32's INCH CREEPBACK | |
| COMPOSITION | SUBSTRATE | Iron Phosphate | Zinc Phosphate |
| Deionized Water (Comparative) | Electrogalvanized (1 week Salt Spray) | >16, >16, >16 | 9 |
| CHEMSEAL 20 (Comparative) | Electrogalvanized (1 week Salt Spray) | 9, 12, 7 | 2 |
| CHEMSEAL 59 (Comparative) | Electrogalvanized (1 week Salt Spray) | >16, >16, >16 | 7 |
| Post Rinse Composition of Example 12 | Electrogalvanized (1 week Salt Spray) | 2, 2, 2 | 3 |
| Deionized Water (Comparative) | Galvaneal (1 week salt spray) | 11, 9, >16 | 4 |
| CHEMSEAL 20 (Comparative) | Galvaneal (1 week salt spray) | 2, 2, 4 | 1 |
| CHEMSEAL 59 (Comparative) | Galvaneal (1 week salt spray) | 6, 12, 11 | 4 |
| Post Rinse Composition of Example 12 | Galvaneal (1 week salt spray) | 1, 3, 2 | 1 |

Good corrosion resistance is achieved for these different substrates as shown by the lower values in Table V for the rinse solution of example 12.

We claim:

1. A non-chrome post-rinse concentrate to be diluted for treating phosphated metal substrates comprising:

A. the reaction product of:

an epoxy-functional material containing at least two epoxy groups; and an alkanolamine, or a mixture of alkanolamines;

and

B. a material selected from the group consisting of Group IV-B metal ion, or a mixture of Group IV-B metal ions.

2. The composition of claim 1 wherein the Group IV-B metal ion is selected from the group consisting of: zirconium, titanium, and hafnium.

3. The composition of claim 1 wherein the epoxy-functional material contains aromatic groups.

4. The composition of claim 3 wherein the epoxy-functional material is the diglycidyl ether of a polyhydric phenol.

5. The composition of claim 1 wherein the reaction product is prepared using a primary or a secondary alkanolamine, or mixtures thereof.

6. The composition of claim 5 wherein the reaction product is prepared using diethanolamine.

7. The composition of claim 2 wherein the zirconium ions are added as a solution of fluorozirconic acid.

8. The composition of claim 2 wherein the titanium ions are added as a solution of fluorotitanic acid.

* * * * *